US006306499B1

(12) United States Patent
Ochi et al.

(10) Patent No.: US 6,306,499 B1
(45) Date of Patent: Oct. 23, 2001

(54) SOFT STRETCH YARNS AND THEIR METHOD OF PRODUCTION

(75) Inventors: Takashi Ochi; Katsuhiko Mochizuki; Yuhei Maeda, all of Shizuoka (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/589,233

(22) Filed: Jun. 7, 2000

(30) Foreign Application Priority Data

Jun. 8, 1999 (JP) ..... 11-160548
Aug. 25, 1999 (JP) ..... 11-238240

(51) Int. Cl.[7] ..... D01F 6/00; D01F 8/00

(52) U.S. Cl. ..... 428/364; 428/395; 428/370; 428/373

(58) Field of Search ..... 428/364, 370, 428/374, 395, 373

(56) References Cited

U.S. PATENT DOCUMENTS 4,217,321 * 8/1980 Campbell ..... 428/373

FOREIGN PATENT DOCUMENTS

| | | |
|---|---|---|
| 1 075 689 | 7/1967 | (GB) . |
| 1 406 335 | 9/1975 | (GB) . |
| 52-021419 | 2/1977 | (JP) . |
| 57-089617 | 6/1982 | (JP) . |
| 58-013720 | 1/1983 | (JP) . |
| 8-109517 | 4/1996 | (JP) . |
| 11-189923 | 7/1999 | (JP) . |

* cited by examiner

*Primary Examiner*—N. Edwards
(74) *Attorney, Agent, or Firm*—Schnader Harrison Segal & Lewis LLP

(57) ABSTRACT

A soft stretch yarn substantially comprising polyester fibers has a stress, at 50% yarn stretch, of no more than $30\times10^{-3}$ cN/dtex and, at the same time, a percentage recovery of at least 60%. Preferably, the Uster unevenness is no more than 2.0% and the crimp diameter is no more than 250 $\mu$m. This soft stretch yarn can be produced by spinning yarn of conjugate fibers comprising two types of polyester in which one component is PTT at a take-up velocity of at least 1200 m/min, drawing at a drawing temperature of 50 to 80° C. at a draw ratio such that the drawn yarn tensile elongation is 20 to 45%, and then heat setting.

24 Claims, 7 Drawing Sheets

Stress–Strain hysteresis curve diagram

Stress–Strain hysteresis curve diagram crimp stretch factor (%) $=(L_1 - L_2)/L_1 \times 100(\%)$ heat treatment:15 mins in boiling water +
15 mins dry heat at 180° C

SOFT STRETCH YARNS AND THEIR METHOD OF PRODUCTION

TECHNICAL FIELD

The present invention relates to soft stretch yarns which, by means of their outstanding crimpability, can confer soft stretchability on fabrics, and to the fabrics formed using said yarns.

1. Prior Art

Synthetic fibre fabrics are outstanding in their durability, easy-care characteristics and the like when compared to natural fibre fabrics and semi-synthetic fibre fabrics, and are widely used. However, when compared to natural fibre fabrics and semi-synthetic fibre fabrics, they are inferior in terms of aesthetic appearance and handle, so various improvements have been made in the past. One approach has been to imitate natural or semi-synthetic fibres. On the other hand, in terms of appearance and handle, improvements have been actively pursued in recent years directed towards the synthetic fibres themselves, quite distinct from natural fibres and semi-synthetic fibres. Amongst these, considerable research has been conducted to broaden the areas where natural or semi-synthetic fibres are poor and synthetic fibres superior. One such major area is the characteristic known as stretch.

With regard to the conferring of stretchability, hitherto there has been employed for example the method of mixing polyurethane fibre into a woven fabric to impart stretchability. However, polyurethane fibre has problems such as the hardness of handle inherent in the polyurethane itself, and a lowering of the handle and drape of the fabric. Moreover, polyurethane is difficult to dye by the dyestuffs employed for polyester and, when used in combination with polyester fibre, not only is the dyeing process complex but also dyeing to a desired colour is difficult.

Hence, as a method which does not use either polyurethane fibre or false-twist textured yarn, polyester fibres employing side by side polymer conjugation have been variously proposed.

For example, in JP-44-2504 and in JP-A-4-308271, there are described side by side bicomponent fibres of polyethylene terephthalate (PET) with different intrinsic viscosities or intrinsic viscosities; and in JP-A-5-295634 there is described a side by side bicomponent fibre of homo PET and copolymer PET of higher shrinkage than the homo PET. When such polyester fibres with latent crimpability are used, it is indeed possible to obtain a certain degree of stretchability but there is the disadvantage that a high stress is generated when the fabric is stretched, that is to say there is a strong feeling of tightness and a hard fabric is formed. Moreover, with side by side bicomponent fibres of this kind, there is the problem that the capacity to manifest crimp in a constrained state within a woven material is low, or the crimp is readily permanently distorted by external forces. Side by side bicomponent fibre yarns do not utilize stretchability based on a substrate polymer such as a polyurethane fibre but, in order to provide the stretchability, utilize the crimp manifested as a result of the difference in shrinkage between the polymers in the conjugate fibre, with the polymer of higher shrinkage forming the inside of the crimp. Hence, it is thought that the aforesaid problems arise when, for example, heat treatment is carried out with the shrinkage of the polymer restricted as in the case when present in a woven fabric, and heat setting takes place in this state, so that the shrinkage capacity beyond this constrained state is lost.

Furthermore, side by side bicomponent fibre yarns employing polytrimethylene terephthalate (PTT) or polybutylene terephthalate (PBT), which are polyesters with slight stretchability, are described in JP-43-19108, but in Example 15 of that publication it states that the power required for stretching is large. In fact, when estimated from the finished yarn counts of the heat treated fabric, in Example XV-d the stress generated at 30% stretch is rather high at $60\times10^{-3}$ cN/dtex or more, and so there is a strong sense of tightness. In addition, when we conducted follow-up experiments, we found disadvantages in that the Uster unevenness (U%) was poor and dyeing unevenness when in the form of fabric was considerable.

2. Objective of the Invention

The present invention aims to resolve the problems of a strong feeling of tightness and coarsening of the fabric, and the problems brought about by yarn unevenness, which are problems associated with conventional side by side bicomponent fibre yarns, and to provide soft stretch yarns which can give fabrics with more outstanding soft stretchability and more outstanding uniformity of dyeing than hitherto, together with the fabrics produced from said yarns.

DISCLOSURE OF THE INVENTION

The present invention provides, according to one aspect, a yarn (Y) substantially comprising (and preferably consisting of) polyester fibres, which yarn (Y) is characterized in that, following heat treatment, the yarn has a stress at 50% yarn stretch of no more than $30\times10^{-3}$ cN/dtex and, at the same time, a percentage recovery of at least 60%. Preferably, the Uster unevenness is no more than 2.0% and the diameter of the crimp is no more than 250 $\mu$m. It is also preferable for the fibres to be conjugate, more preferably multi-segment (side by side) or a core sheath (ie. having an eccentric cross section) fibres having at least two components each of different respective polyesters.

According to a method aspect, the invention provides a method (A) of producing a yarn by spinning a yarn of conjugate fibres comprising two types of polyester in which, preferably, PTT is one component, at a take-up velocity of at least 1200 m/min, drawing at a drawing temperature of 50–80° C. and a draw ratio which gives a drawn fibre elongation of 20 to 45%, and then heat setting.

According to other method aspects, the invention provides respective methods (B) and (C) of providing a yarn, in which method (B) a yarn of a conjugate fibre comprising two types of polyester is spun from a spinneret and taken up at a take-up velocity of at least 4000 m/min by providing a non-contact heater between the spinneeeret and a godet roller and in which method (C) a yarn of a conjugate fibre comprising two types of polyester is spun at a take-up velocity of at least 5000 m/min.

Each of the above methods may be utilized to produce a yarn (Y) having the above characteristics and thereby allow a soft stretch yarn to be obtained which at least partially remove the abovementioned problems.

BRIEF EXPLANATION OF THE DRAWINGS

Practical embodiments if the invention will now be described with reference to the accompanying drawings which.

Figure 1:
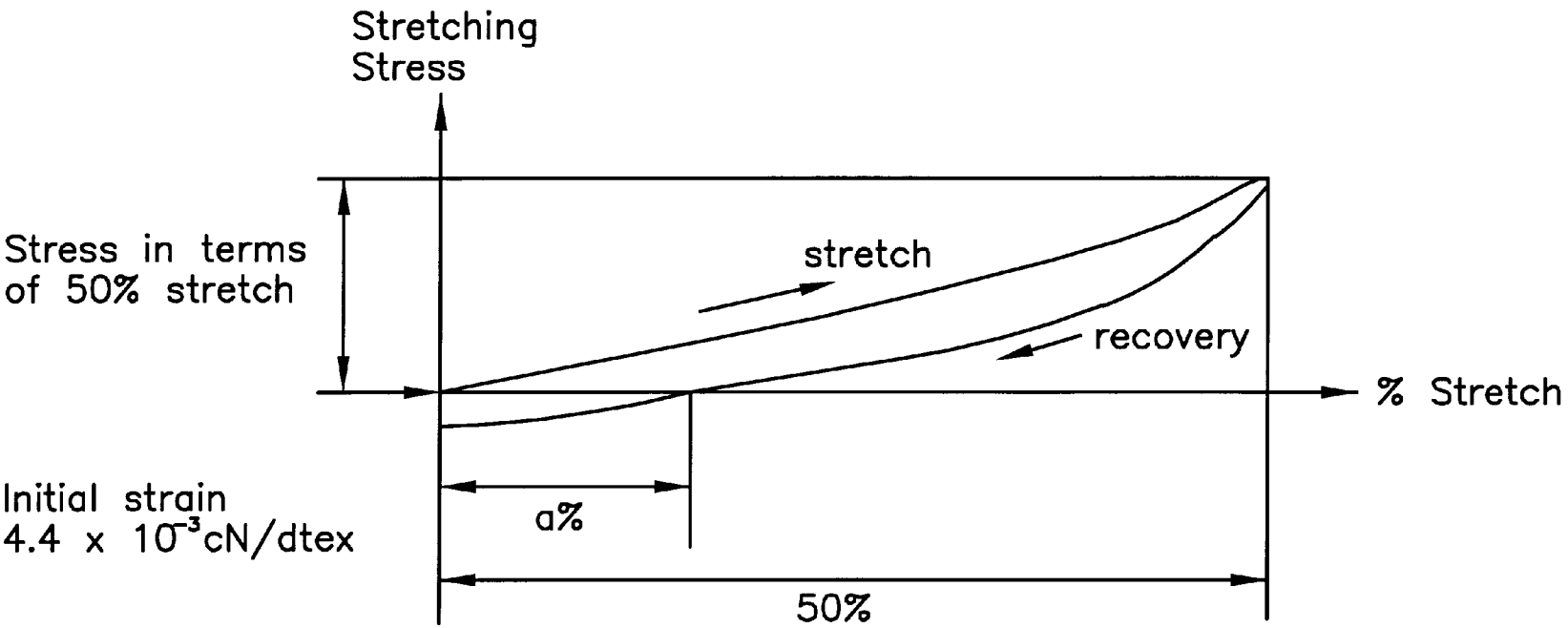
FIG. 1 is a diagram showing the stress-strain hysteresis curve a yarn embodying the invention.

Explanation of the numerical codes:

1: spinning block
2: nonwoven filter
3: spinneret
4: cooling chimney
5: yarn
6: oiling guide
7: interlacer nozzle
8: 1st godet roller (1GD)
9: 2nd godet roller (2GD)
10: winder
11: undrawn yarn
12: feed roller (FR)
13: 1st hot roller (1HR)
14: 2nd hot roller (2HR)
15: cold roller
16: drawn yarn
17: hot plate
18: 1st hot nelson roller (1HNR)
19: 2nd hot nelson roller (2HNR)
20: non contact heater
21: steam setter

PRACTICAL EMBODIMENTS OF THE INVENTION

In a yarn embodying the present invention, in order to achieve soft stretchability, it is important that the resistance to yarn stretch be low and that the recovery from stretch be high, and these characteristics can be evaluated by means of the stress when the yarn is stretched 50% and the percentage recovery in the stress-strain hysteresis curve (FIG. 1). In practice, the hank-wound yarn is heat treated and crimp manifested, after which an initial tension of $4.4\times10^{-3}$ cN/dtex (5 mgf/d) is applied to the yarn using an automatic tensile testing machine, then the yarn stretched 50% and the stress read off.

In the case of the soft stretch yarn of the present invention, it is important that the stress at 50% yarn stretch be no more than $30\times10^{-3}$ cN/dtex and, in this way, it is possible to obtain good soft stretchability and there can be obtained soft fabrics with no feeling of tightness. On the other hand, with a conventional side by side bicomponent yarn, the stress at 50% yarn stretch is high, exceeding $50\times10^{-3}$ cN/dtex, so only fabrics with a strong sense of tightness and a coarse feel are obtained. The stress at 50% yarn stretch is preferably no more than $10\times10^{-3}$ cN/dtex. Furthermore, in order to obtain sufficient stretchability, it is important that the recovery be at least 60%. Preferably, the recovery is at least 70%.

Again, when the crimp diameter of the soft stretch yarn following heat treatment is less than 250 $\mu$m, soft stretchability is readily manifested and, furthermore, when fabric is produced, coarseness of the fabric surface is suppressed and it is possible to obtain a material of high quality, so this is preferred. The crimp diameter of the soft stretch yarn is more preferably no more than 200 $\mu$m.

Furthermore, if the crimp phase between the individual filaments is uniform, a fine crepe is raised when formed into a fabric and it is possible to obtain fabric with an attractive surface. On the other hand, if there is a divergence in the crimp phase between the individual filaments, it is easier to form a fabric with a plain surface and it is possible to produce a fabric with good smoothness.

Moreover, where the crimp stretch factor ($E_0$) after heat treatment substantially under no load is at least 45%, the stretchability is further enhanced and this is preferred. Here, the crimp stretch factor is an index denoting the degree of crimp, and the higher the value of the crimp stretch factor the higher the degree of crimp and the better the stretchability. $E_0$ is more preferably at least 60%. $E_0$ reflects the extent of crimping under no load. However, in the case where a side by side bicomponent fibre yarn is in the form of a high twist yarn or a fabric, sometimes there is constraint by the high twisting or a constraining force acts due to the weave structure, so that it is difficult for crimp to be manifested. Hence, the crimp stretch factor under load may also be important, and this property can be assessed from the crimp stretch factor ($E_{3.5}$) when a load of $3.5\times10^{-3}$ cN/dtex (4 mgf/d) is applied. In the case of the soft stretch yarn of the present invention, $E_{3.5}$ is preferably at least 10%. On the other hand, with conventional polyethylene terephthalate type side by side bicomponent yarns, $E_{3.5}$ is about 0.5%, and so in cases where a high twist yarn or a fabric is produced crimp is not readily manifested and there is poor stretchability. $E_{3.5}$ is preferably at least 14%.

Furthermore, if the percentage crimp retention after repeatedly stretching 10 times is at least 85%, then the crimp does not readily show permanent deformation and the shape retentivity when the fabric is stretched is markedly raised, so this is preferred. The crimp retention after stretching 10 times is preferably at least 90% and more preferably at least 95%. On the other hand, with conventional polyethylene terephthalate type side by side bicomponent yarns, the crimp retention after stretching 10 times is less than 80% and the shape retentivity when the fabric is stretched is poor.

Again, in order that high twist or weaving constraints be surmounted and crimp still be manifested, the shrinkage stress may also be important, and it is preferred that the maximum value of the stress be at least 0.25 cN/dtex (0.28 gf/d). More preferably, the maximum value of the stress is at least 0.30 cN/dtex (0.34 gf/d). Moreover, the temperature at which the maximum shrinkage stress is shown is preferably at least 110° C.

In addition, if the initial modulus of the yarn is no ore than 60 cN/dtex, the fabric is softer and so this is preferred. The initial modulus of the yarn is preferably no more than 50 cN/dtex.

Furthermore, if there is excessive fabric shrinkage in subsequent fabric processing stages, coarsening will occur, so it is preferred that the dry heat shrinkage of the soft stretch yarn be no more than 20%.

In the present invention, It is preferable that the Uster unevenness, which is a measure of the unevenness of the yarn denier (thickness unevenness), be no more than 2.0%. In this way, not only is it possible to avoid the occurrence of fabric dyeing unevenness, but also yarn shrinkage unevenness when in the form of fabric is suppressed and it is possible to obtain an attractive fabric surface. The Uster unevenness is more preferably no more than 1.2%.

Again, the strength of the soft stretch yarn is preferably at least 2.2 cN/dtex (2.5 gf/d) from the point of view of smooth passage of the soft stretch yarn through subsequent processing stages and the securing of adequate tear strength in the form of fabric. The strength is more preferably at least 3.0 cN/dtex (3.4 gf/d). Moreover, from the point of view of yarn handling, the elongation of the soft stretch yarn is preferably 20 to 45%.

It is especially preferred that the structure of a soft stretch yarn embodying the present invention is a conjugate fibres having at least two components, wherein, in cross-section, respective components are each disposed eccentrically relative to another component (and most preferably, where at least one component is PTT), that is to say either a side by side type multi-, especially bicomponent fibres or eccentrically disposed sheath core conjugate fibres. Hereinafter, such fibres are referred to as "eccentric conjugate fibres". With such fibres, the stress at 50% yarn stretch is readily lowered and, furthermore, the percentage recovery can readily be raised at the same time. Moreover, if two polyesters with a large difference in melt viscosity are employed, then the stretch characteristics, namely the recovery in terms of 50% yarn stretch and the crimp stretch factor, are enhanced, so this is preferred. Again, where PTT is on the inside of the crimp, the stretchability is further raised so this is preferred. Moreover, if PET is combined with PTT, the heat resistance is raised, so this is preferred. If low viscosity PTT is combined with high viscosity PTT, then the Young's modulus is lowered and better soft stretchability is obtained in the form of a fabric, so this is preferred. Again, if PBT is combined with PTT then the crimp retention factor is raised, permanent deformation of the crimp does not readily occur, and there is improved fabric shape retentivity in terms of stretch, so this is preferred.

As to the conjugate ratio of the polyesters but, from the point of view of the manifestation of crimp, from 3/7 to 7/3 is preferred. From 4/6 to 6/4 is more preferred, with 5/5 being still further preferred.

Herein, PET refers to a condensation polymer employing terephthalic acid as the acid component and ethylene glycol as the diol component; PTT refers to a condensation polymer employing terephthalic acid as the acid component and 1,3-propanediol as the diol component; and PBT denotes a condensation polymer employing terephthalic acid as the acid component and 1,4-butanediol as the diol component. Furthermore, within respective ranges not exceeding 15 mol%, a part of the diol component and/or part of the acid component may be replaced by other copolymerizable component(s). In the case where the copolymerized component is polyethylene glycol, this will be no more than 15 wt%. Again, there may also be added additives such as other polymers, delustrants, fire retardants, antistatic agents and pigments.

Now, if the difference in the melt viscosities of the conjugated polymers is too great, the spinnability may become markedly impaired because fibre bending just under the spinneret occurs. Hence, it may then be necessary to use an insert type complex spinneret (FIG. 2(*b*)) as described in JP-A-11-43835. However, the yarn production properties may then be markedly lowered because of the different residence times of the polyesters in the pack or spinneret. Again, while it is also not impossible to use a spinneret of the kind shown in FIG. 3 of JP-43-19108 where the flow of two polyesters is merged and combined at the same time as extrusion, the conjugate form and the polyester flow rates will tend to be unstable, causing increased yarn unevenness, so this is preferably avoided. Hence, if, the melt viscosity ratio of the two types of polyester is actually decreased, then even by using a simple parallel type spinneret (FIG. 2(*a*)) it is possible to avoid the problem of reduced spinnabillty caused by fibre bending just under the spinneret as described in Sen'i Gakkai-shi {*Journal of the Society of Fibre Sciences and Technology, Japan*} Vol.54, p-173 (1998). Such a combination of melt viscosities has the advantage that it is possible to markedly improved the operational characteristics. The preferred melt viscosity ratio is 1.05:1 to 5.00:1, and more preferably 1.20:1 to 2.50:1. Here, the melt viscosity ratio is defined by the formula given below. The measurement conditions of melt viscosity are a temperature of 280° C. and a strain rate of 6080 $sec^{-1}$, to match the polyester melt spinning conditions.

Melt viscosity ratio=$V_1/V_2$ $V_1$: melt viscosity value of the polymer with the higher melt viscosity $V_2$: melt viscosity value of the polymer with the lower melt viscosity Furthermore, where the melt viscosity of the lower viscosity polyester is 300–700 poise, the spinnability is enhanced, yarn unevenness and yarn breakage are reduced, and the soft stretchability is further enhanced, so this is preferred.

In a yarn embodying the present invention, the fibre cross-sectional shape is not restricted in any way and, for example, cross-sectional shapes of the kind shown in FIG. 3 can be considered. Of these, in terms of a balance between crimpability and handle, a semicircular side by side round cross-section can be selected, but where the aim is a dry handle then a triangular cross-section or where the aim is lightness of weight and thermal insulation a hollow side by side conjugate or other such suitable cross-sectional shape can be selected in accordance with the particular application.

Figure 4:
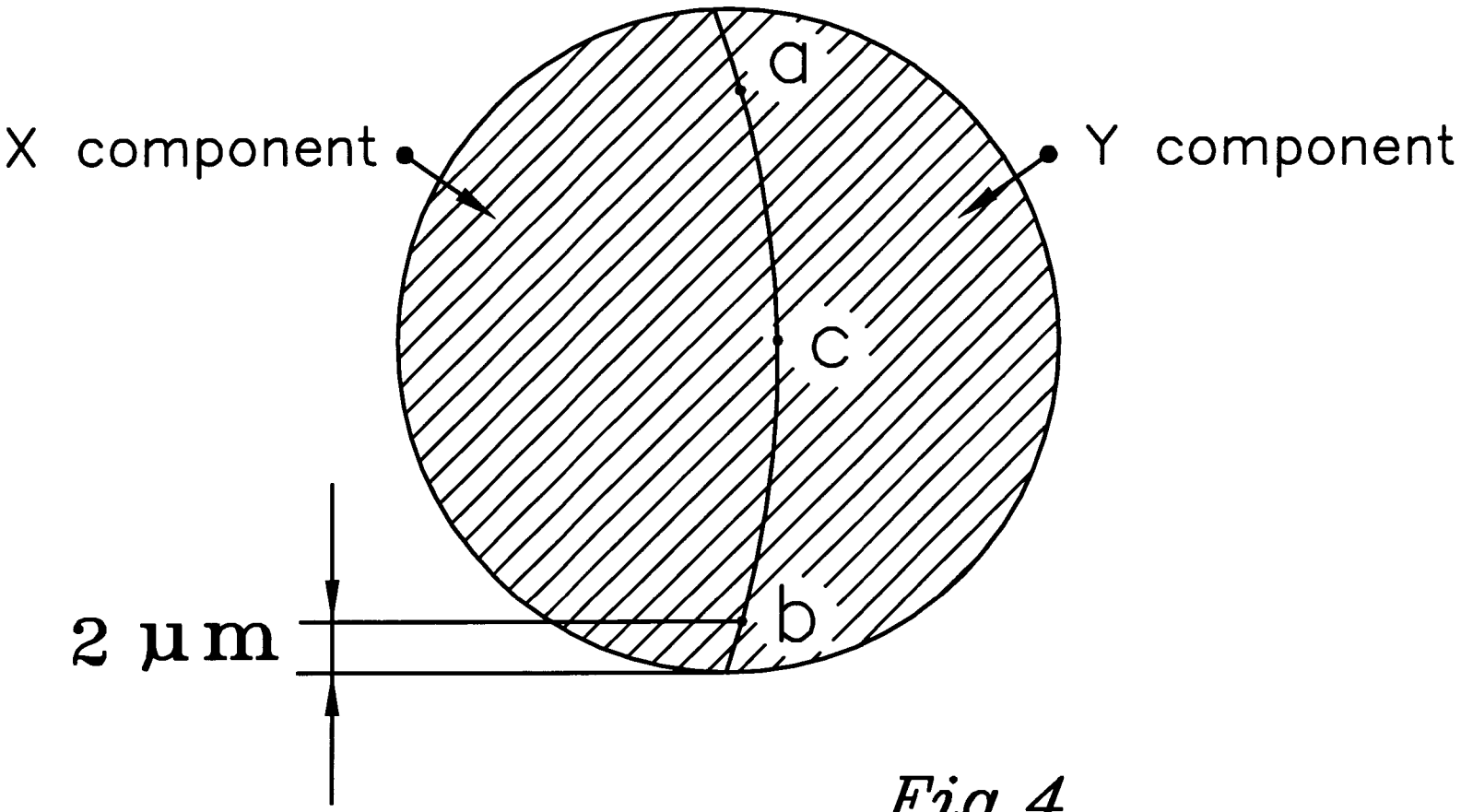
FIG. 4 is a diagram showing the method of calculating the radius of curvature of an interface between two components of a bi-component fibre present in a yarn embodying the invention.

Now, in a yarn embodying the present invention, where the interface in the side by side bicomponent fibre is linear in the filament cross section, the manifestation of crimp is facilitated and stretchability is enhanced. An index of the linearity of the interface is the radius of curvature R ($\mu$m) of the circle which touches the three points a, b and c on the interface in the filament cross-section shown in FIG. 4, where a and b are points of depth 2 $\mu$m in the direction of the centre from the filament surface and c is the point at the centre of the interface. It is preferred that $R \geqq 10 \times D^{0.5}$. Here, D is the fineness of the filament (dtex).

A soft stretch yarn embodying the present invention can, for example, be produced as follows.

Initially, first and second preferred embodiments of the soft stretch yarn production method of the present invention are explained. Specifically, there is the method in which a conjugate fibre, preferably, an eccentric conjugate fibre comprising two type of polyester is spun at a take-up velocity of at least 1200 m/min, and drawn at a drawing temperature of 50–80° C. and preferably at a draw ratio which gives a drawn yarn elongation of 20–45%, followed by heat setting.

Here, with regard to the combination of the two types of polyester forming the conjugate fibre, if the melt viscosity ratio is 1.05:1 to 5.00:1, then the spinnability is enhanced, and if at least one of the polyesters is PTT or PBT then soft stretchability is readily manifested, so this is preferred. More preferably, it is PTT. Again, in order to suppress yarn unevenness, the selection of the spinning temperature and the take-up velocity are important. Since the melting point of PTT is about 30–35° C. lower than that of PET, the spinning temperature is lower than the normal spinning temperature for PET and is preferably set at 250–280° C. In this way, thermal degradation of the PTT or an excessive fall in viscosity thereof can be suppressed, lowering of the yarn strength is prevented and yarn unevenness can be reduced. The spinning temperature is preferably 255 to 275° C. Moreover, by making the take-up velocity at least 1200 m/min, the cooling process during spinning is stabilized, yarn oscillation or trembling in the yarn solidification point can be considerably suppressed, and it is possible to markedly suppress yarn unevenness when compared with yarn spun at lower velocities. Again, there is also the advantage that the yarn strength can be raised. However, at a take-up velocity of about 3000 m/min, the stretch characteristics of the soft stretch yarn may be lowered, and this is preferably avoided. On the other hand, at take-up velocities of 5000 m/min or more, the stretch characteristics are actually raised, so employing high speed spinning is also preferred.

It is desirable that there be taken into consideration the fact that, at the time of drawing and heat setting, the glass transition temperature and melting point of PTT are lower, and the heat resistance inferior, when compared to PET. In particular, in order to suppress yarn unevenness, selection of the drawing temperature is important, and the drawing temperature is 50 to 80° C. In this way, excessive crystallization and thermal degradation of the yarn at the time of the preheating are prevented. Thus, yarn unevenness and also yarn breaks due to yarn oscillation or a change in the point of drawing on the roller or heated pin employed for the preheating are reduced, and the yarn strength is raised. The drawing temperature is more preferably 65 to 75° C. Furthermore, for the purposes of reducing the dry heat shrinkage of the drawn yarn, heat setting is carried out following the drawing. The shrinkage can be kept to less than 20% if the temperature is about 120–160° C. in the case where a hot roller is used as the heat setting means, and similarly if the temperature is about 110–180° C. in the case where a hot plate is used, so this is preferred. Again, when a hot plate is used as the heat setting means, the heat setting can be conducted in a state with the molecular chains under tension, so the yarn shrinkage stress can be raised, which is preferred. Furthermore, the draw ratio is important for the manifestation of the soft stretch properties of the present invention, and it is preferred that this be set such that the elongation of the drawn yarn is 20 to 45%. In this way, it is possible to suppress problems due to an excessively high draw ratio such as breaks in the drawing process, a lowering of the soft stretchability and the occurrence of breaks in the fabric forming process, and it is also possible to avoid troubles due to a low draw ratio such as a lowering of the stretchability and pirn barre in the fabric forming process. The draw ratio is more preferably set such that the drawn fibre elongation is 25–35%.

Figure 6:
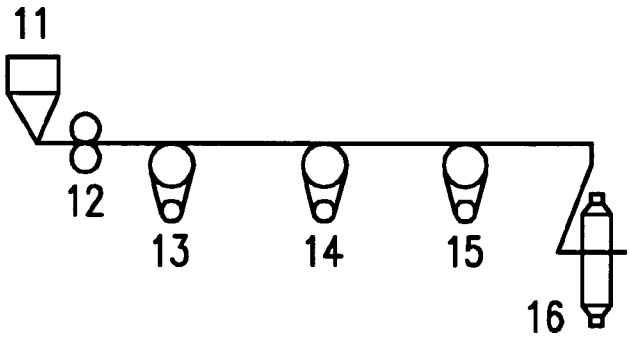
FIG. 6 is a diagram showing a drawing machine for use in another method embodying the invention.
Figure 7:
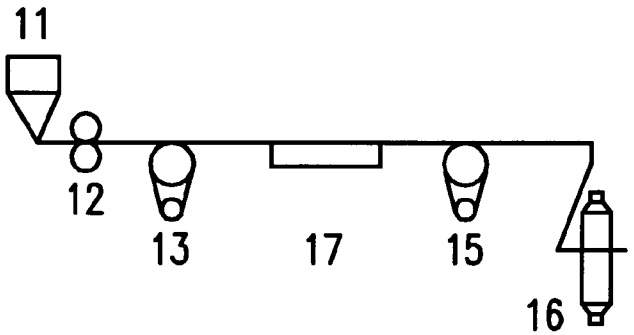
FIG. 7 is a diagram showing a drawing machine for use in yet another method embodying the invention.
Figure 5:
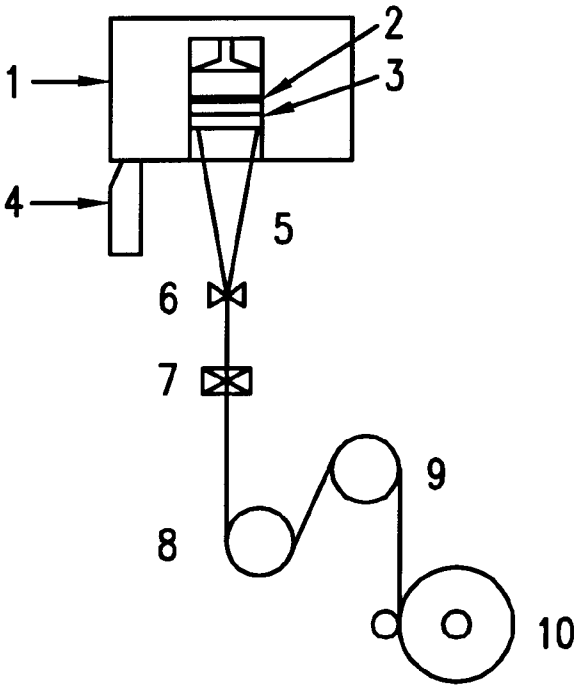
FIG. 5 is a diagram showing a spinning/winding machine for use in a method embodying the invention.

There can be used a two stage spinning and drawing method (the first preferred embodiment) in which the spun yarn is temporarily wound up, after which it is then drawn, or the direct spin draw method in which the spun fibre is drawn as it is without firstly being wound up (the second preferred embodiment). A more specific explanation of the two-stage spinning/drawing method is now provided with reference to the drawings. With reference to FIG. 5, the molten polyesters in spinnng block 1 are filtered using a filter such as nonwoven filter 2 and spun from spinneret 3. The spun yarn 5 is cooled by means of cooling equipment such as cooling chimney 4 and oiled via oiling device 6, after which entanglement is optionally conferred by means of an interlace nozzle such as air nozzle, and then take-up performed by means of first take-up roller (1GD) 8 and second take-up roller (2GD) 9, followed by wind-up by means of winder 10. Here, the peripheral velocity of 1GD 8 is the take-up velocity. Next, the wound undrawn yarn 11 is subjected to drawing and heat setting by means of a known drawing machine. For example, in FIG. 6, the undrawn yarn 11 is fed from feed roller (FR) 12, after which it is preheated by means of first hot roller (1HR) 13, and drawing carried out between 1HR 13 and second hot roller (2HR) 14. Furthermore, after heat setting at 2HR 14, the yarn passes via cold roller 15 and is wound up as drawn yarn 16. Again, in FIG. 7 there is shown an example where a hot plate 17 is used instead of 2HR 14 as the heat setting means. Now, the temperature of 1HR 13 is the drawing temperature, the temperature of 2HR 14 or of hot plate 17 is the heat setting temperature, and the velocity of cold roller 15 is the drawing velocity.

Next, a more specific explanation is given of the direct spin draw method with reference to the drawings.

Figure 8:
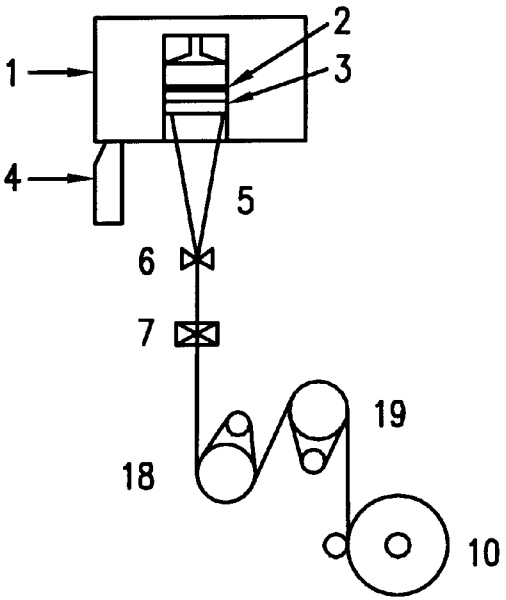

Referring to FIG. 8, the molten polyesters are filtered using a filter such as nonwoven filter 2 and spun from spinneret 3. Furthermore, the spun yarn is cooled by means of a cooling device such as cooling chimney 4 and oiled using oiling means 6, after which entanglement is optionally conferred by means of an interlace nozzle such as air nozzle 7, and then the yarn taken up by means of first hot nelson roller (1HNR) 18 and, following preheating, drawing carried out between this and second hot nelson roller (2HNR) 19. After heat-setting at 2HNR 19, it is wound up by means of winder 10. Here, the peripheral velocity of 1HNR 18 is the take-up velocity, the temperature of 1HNR 18 is the drawing temperature and the temperature of 2HNR 19 is the heat setting temperature.

When the direct spin draw method is adopted in this way instead of the conventional two stage spinning and drawing method, there is the merit that the production process can be made more efficient and costs reduced. Moreover, the phase of the crimp in the soft stretch yarn tends to be more random and, in particular in the case where the yarn is employed without twisting, the shrinkage of the yarn in the fabric occurs randomly, with the result that there is the merit that a plain fabric with good smoothness is readily obtained.

Next, as a third embodiment of the method of producing soft stretch yarn of the present invention, a simplified direct spin draw method is explained with reference to FIG. 9. Here, a non contact heater 20 is provided on the spinning line between spinneret 3 and 1GD 8, and by taking up the aforesaid conjugate, preferably, eccentric conjugate fibres at a high take-up velocity of at least 4000 m/min, drawing automatically takes place due to the airdrag in non contact heater 20, after which heat setting is performed, preferably by means of a steam setter 21. At this time, since the yarn passes through the non contact heater in a non-constrained state, the drawing and heat setting take place randomly between the individual filaments, and the crimp phase difference in the soft stretch yarn can be made even more random than at the time of the aforesaid direct spin draw method with a hot roller, and so is preferred.

Next, as a fourth embodiment of the method of producing the soft stretch yarn of the present invention, a high velocity spinning method is explained with reference to FIG. 5. In FIG. 5, by taking up the aforesaid conjugate fibres at a take-up velocity of 5000 m/min or above, drawing is automatically produced by the airdrag between spinneret 3 and 1GD 8, and heat setting is carried out by the heat possessed by the yarn itself.

Now, if a twist of at least 100 turns/m is applied to the soft stretch yarn of the present invention, the phase of the crimp is readily made more uniform and stretchability is more readily manifested in the fabric state, so this is preferred. Again, generally speaking, when a side by side bicomponent yarn is produced as a high twist yarn, the crimpability is poor and the stretchability lowered, but in the case of the soft stretch yarn of the present invention $E_{3.5}$ is very high compared to a conventional PET type side by side conjugate fibre, so adequate stretchability is manifested even in the form of a high twist yarn. Reference here to high twist means applying twist at a twist coefficient of at least 5000, and in the case of yarn of fineness 56 dtex, the number of twists will be at least 700 turns/m. The twist coefficient is defined as the product of the number of twists (turns/m) and the square root of the denier (dtex x 0.9).

The soft stretch yarn embodying the present invention can also be used twist-free, and in this case if there is a divergence in crimp phase between the individual filaments of the yarn, the woven material surface will be plain and, for example, it can be employed as a stretchable lining with excellent smoothness. Moreover, another merit is that the bulkiness is higher compared to the case where the crimp is uniformly arranged.

When a soft stretch yarn embodying the present invention is employed in a knitted material, it is possible to produce an outstanding stretchable knitted fabric with soft stretch properties not achievable in a conventional knitted fabric. In particular, with a knitted fabric, since the fabric shrinks in a state where the constraining forces are weak in the subsequent processing stages, the apparent shrinkage including that due to crimping is marked and the knitted loops are closed up, so in cases where a stretch yarn is used the fabric is readily coarsened. Hence, in a knitted fabric, the soft stretchability possessed by the yarn itself is a particularly important parameter, and by using the soft stretch yarn of the present invention it is possible to obtain soft stretch knitted fabrics unattainable hitherto. Again, if there is used a soft stretch yarn in which the crimp phase is uniformly arranged, a fine crimp is readily produced between the knitted loops and a fine crepe is formed, and so it is possible to obtain a highly attractive knitted fabric.

Moreover, if a soft stretch yarn embodying the present invention is employed in the form of a combined filament yarn along with a low shrink yarn comprising polyester or nylon of boiling water shrinkage no more than 10%, then not only is the sense of softness increased but also the bulkiness and resilience are enhanced, which is desirable. If, comparatively speaking, the low shrinkage yarn is present at the outer periphery of the soft stretch yarn, then it has a cushioning role and the sense of softness is further enhanced. Again, the yarn diameter as a multifilament is increased and so the sense of bulkiness is raised. For this purpose, it is advantageous if the boiling water shrinkage of the low shrink yarn be low. More preferably, the boiling water shrinkage is no more than 4% and still more preferably it is no more than 0%. Again, it is advantageous if the initial modulus of the low shrink yarn is also low, preferably no more than 50 cN/dtex. Furthermore, the finer the individual filament denier of the low shrinkage yarn the greater the sense of softness, so the single filament fineness is preferably no more than 2.5 dtex and more preferably no more than 1.0 dtex.

Again, if a soft stretch yarn embodying the present invention is used as a mixture along with natural fibres and/or semi-synthetic fibres, it is possible to confer stretchability without impairing the moisture absorption/release properties and the outstanding handle such as coolness to the touch and resilience possessed by the natural or semi-synthetic fibres. Mixture here refers to a combined yarn or to a combined weave or combined knit. In order to balance the characteristics possessed by the soft stretch yarn and the handle of the natural or semi-synthetic fibres, it is preferred that the total weight of natural fibres or semi-synthetic fibres be from 10 to 90% of the fabric weight.

Yarns embodying the present invention can be used advantageously for textile materials such as socks, shirts, blouses, cardigans, trousers, skirts, one-piece costumes, suits, sportswear, lingerie and linings.

EXAMPLES

Preferred embodiments of the present invention will now be described in more detail with reference to the following Examples, in which the following methods were employed as the methods of measurement.

A. Stress at 50% yarn strain, and the percentage recovery

Firstly, the yarn was wound in the form of a hank, and then a heat treatment carried out by immersion for 15 minutes in boiling water in a substantially load free state. Next, using an automatic tensile testing machine, an initial tension of $4.4\times10^{-3}$ cN/dtex (5 mgf/d) was applied to this heat-treated yarn at an initial sample length of 50 mm, then the yarn stretched 50% at a rate of extension of 100%/min, after which it was immediately returned to 0% extension at the same rate, and the hysteresis curve measured (FIG. 1). The maximum attained stress, based on the initial tension, was taken as the stress at 50% stretch. The percentage recovery was calculated from FIG. 1, using the relation:- percentage recovery (%)=[(50−a)/50]×100%. Here, 'a' is the percentage extension at the point when the stress in the recovery process of the hysteresis curve reaches the initial tension.

Figure 10:
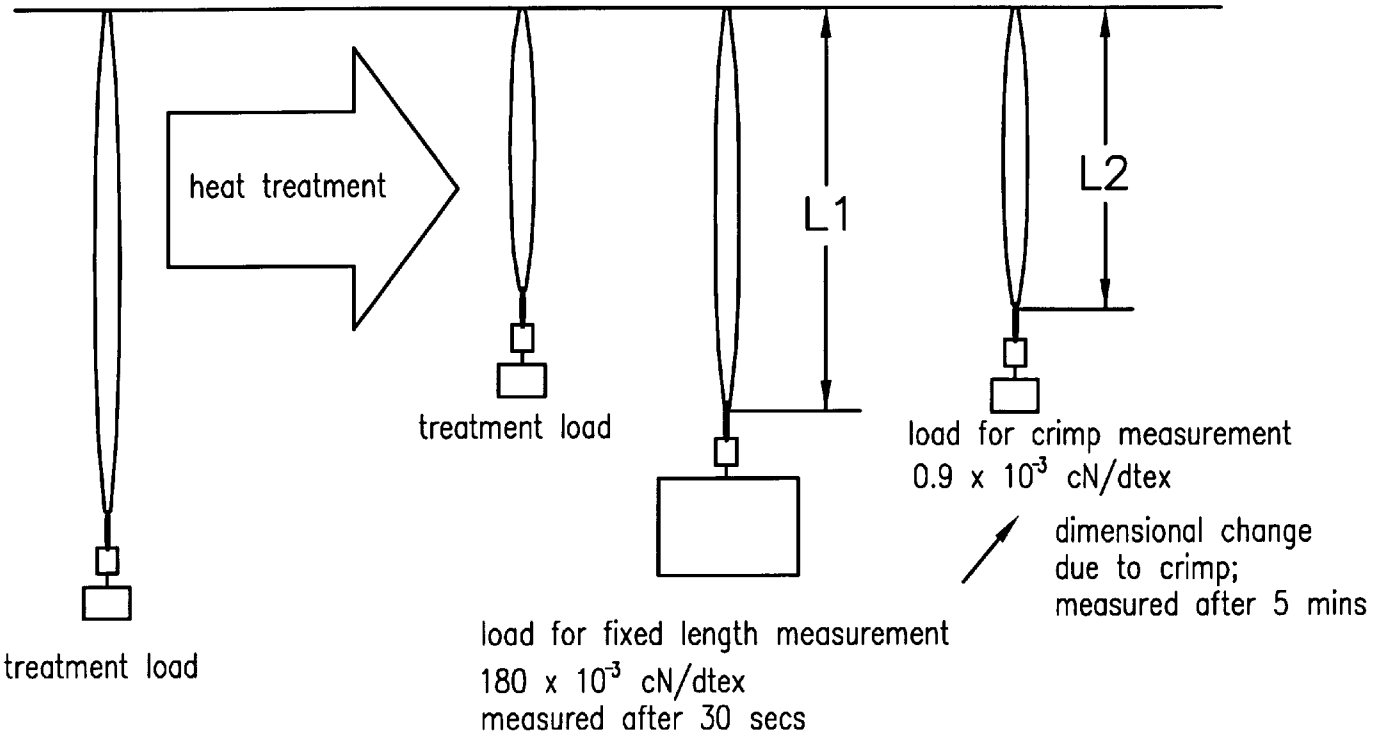
FIG. 10 is a diagram showing the crimp stretch factor measurement method for use in still further methods embodying the invention.

B. Crimp stretch factor (FIG. 10)

$$\text{crimp stretch factor (\%)}=[(L_1-L_2)/L_1]\times100\%$$

$L_1$: hank length with a load of $180\times10^{-3}$ cN/dtex applied, after having subjected the fibre hank to 15 minutes treatment in boiling water and then 15 minutes dry heat treatment at 180° C.

$L_2$: the hank length when, following measurement of $L_1$, the load applied is changed from $180\times10^{-3}$ cN/dtex (0.2 gf/d) to $0.9\times10^{-3}$ cN/dtex (1 mgf/d)

$E_0$: crimp stretch factor after having been heat treated under substantially no load $E_{3.5}$: crimp stretch factor after having been heat treated under a load of $3.5\times10^{-3}$ cN/dtex (4 mgf/d)

C. Percentage crimp retention $E_1$ was measured with the load at the time of the heat treatment in the measurement of the crimp stretch factor made $0.9\times10^{-3}$ cN/dtex (1 mgf/d). Furthermore, after applying a heavy load ($180\times10^{-3}$ cN/dtex) and a light load ($0.9\times10^{-3}$ cN/dtex) and repeating this nine times, so that stretching/recovery was performed a total of 10 times, the hank length $L_{10}$ was measured with the light load applied.

The crimp stretch factor $E_1^{10}$ (%) following the stretching was determined from the relationship given below, and the percentage crimp retention was determined from the ratio in terms of the initial crimp stretch factor.

$$\text{Percentage crimp retention (\%)}=[E_1^{10}/E_1]\times100\ (\%)$$

$$E_1^{10}(\%)=[(L_0'-L_{10}')/L_0']\times 100\ (\%)$$

D. Crimp diameter

Figure 11:
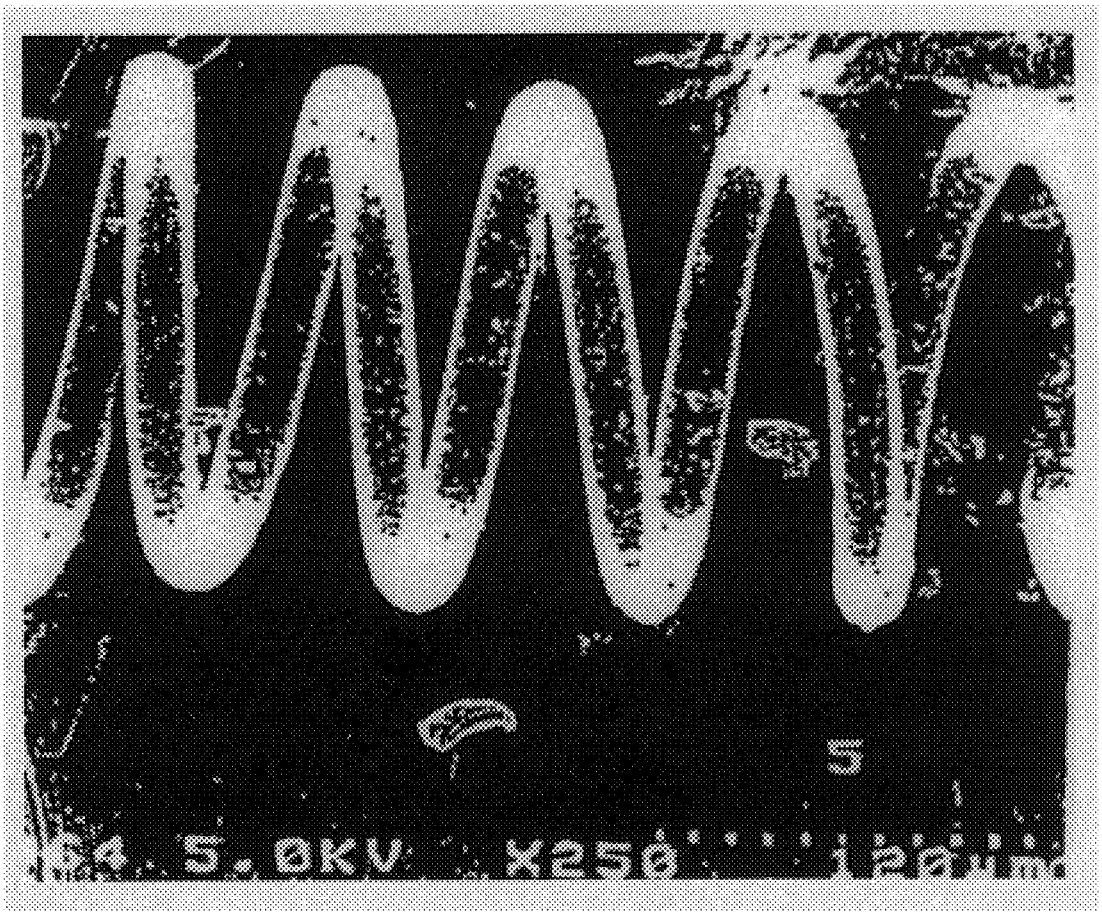
FIG. 11 is an electron micrograph showing one example of the soft stretch yarn crimp shape.

Following the measurement of $E_0$, the yarn was sampled in a state with, as far as possible, no force applied, and then observation performed with a scanning electron microscope (FIG. 11). The diameters (outer diameters) of 100 randomly selected crimps were measured and the average value thereof taken as the crimp diameter.

E. Uster unevenness (U%)

This was measured using a Uster Tester 1 Model C, manufactured by the Zellweger Co., in the normal mode while supplying yarn at a rate of 200 m/min.

F. Shrinkage stress

This was measured using a thermal stress measurement instrument manufactured by Kanebo Engineering Co., at a heating rate of 150° C./min. Sample=10 cm×2 loop, with initial tension=fineness (decitex)×0.9×(1/30) gf.

G. Tensile strength and elongation

With the initial sample length=50 mm and the rate of extension=50 mm/min (100%/min), the stress-strain curve was determined under the conditions given in Japanese Industrial Standard (JIS) L1013. The extension divided by the initial sample length was taken as the tensile elongation.

H. Melt viscosity

Measurement was carried out under a nitrogen atmosphere, using a Capilograph 1B, manufactured by the Toyo Seiki Co. Measurement was carried out three times at a measurement temperature of 280° C. and a strain rate of 6080 $sec^{-1}$, with the average value being taken as the melt viscosity.

I. Intrinsic viscosity

Measured in o-chlorophenol at 25° C.

J. Initial modulus

Measured in accordance with JIS L1013.

K. Boiling water shrinkage and dry shrinkage $$\text{boiling water shrinkage } (\%)=[(L_0''-L_1'')/L_1'']\times 100\%$$

$L_0''$: original hank length when drawn yarn is wound in the form of a hank and an initial load of 0.18 cN/dtex (0.2 gf/d) applied $L_1''$: hank length under an initial load of 0.18 cN/dtex (0.2 gf/d), after the hank used to measure $L_0''$ was treated for 15 minutes in boiling water in a substantially load free state, and then air dried $$\text{dry heat shrinkage } (\%)=[(L_0''-L_2'')/L_0'']\times 100\%$$

$L_2''$: hank length under an initial load of 0.18 cN/dtex (0.2 gf/d), after the hank used to measure $L_1''$ was dry heat treated for 15 minutes at 180° C. in a substantially load free state, and then air dried L. Evaluation of handle The fabrics obtained in the examples and comparative examples were evaluated on a scale of 1 to 5 in terms of soft feel, bulkiness, resilience, stretchability, dyeing evenness and surface impression (attractiveness of the fabric surface). A grade of 3 or more was acceptable.

Example 1

Figure 2A:
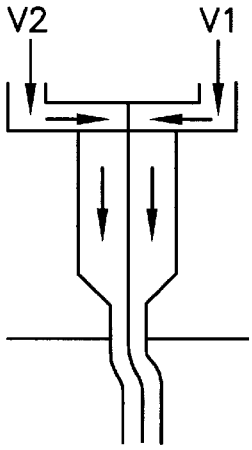
FIG. 2 shows, diagrammatically, spinnerets used for side by side bicomponent fibre spinning in a method. embodying the invention.
Figure 2B:
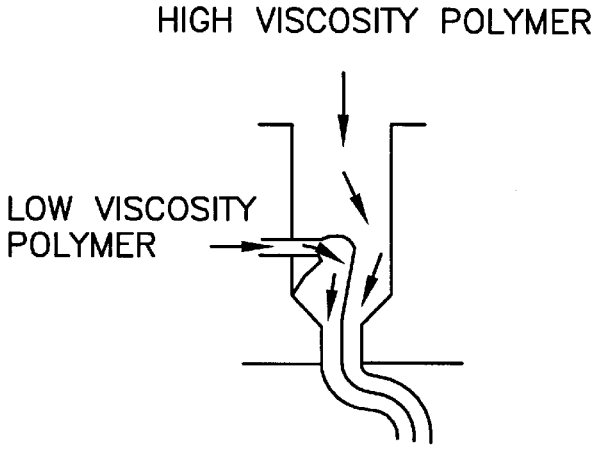
Figure 3A:
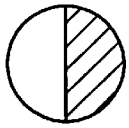
FIG. 3 shows, diagrammatically, various fibre cross-sectional shapes of polyester fibres of yarns embodying the invention.
Figure 3B:
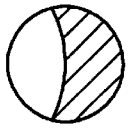
Figure 3C:
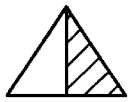
Figure 3D:
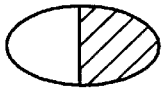
Figure 3E:
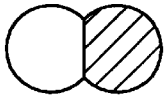
Figure 3F:
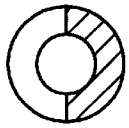
Figure 3G:
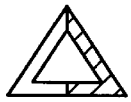
Figure 3H:
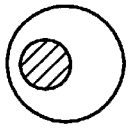
Figure 3I:
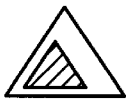
Figure 3J:
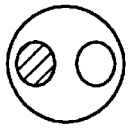

Titanium dioxide-free homo PTT of melt viscosity 400 poise and homo PET of melt viscosity 370 poise containing 0.03 wt% titanium dioxide were separately melted at 260° C. and 285° C. respectively, and then each filtered using stainless steel nonwoven filters of maximum pore diameter 15 μm, after which they were spun at a spinning temperature of 275° C. from a 12-hole parallel type spinneret (FIG. 2(*a*)) to form side by side bi-component fibre (FIG. 3(*b*)) of conjugate ratio 1:1. The melt viscosity ratio at this time was 1.08. At a take-up velocity of 1500 m/min, 168 dtex 12-filament undrawn yarn was wound up. Subsequently, using the drawing machine with hot rollers illustrated in FIG. 6, drawing was carried out with the temperature of the 1HR 13 at 70° C. and the temperature of the 2HR 14 at 130° C., at a draw ratio of 3.00. In both the spinning and drawing, yarn production was good and there were no yarn breaks. The properties of the yarn are given in Table 2, and outstanding crimpability was shown with the PTT at the inside of the crimp. Furthermore, the crimp diameter manifested in the heat treatment for measuring $E_0$ was extremely small, at 200 μm, so an extremely high quality product was formed. Moreover, the yarn was sufficiently soft, with an initial modulus of 42 cN/dtex, and the shrinkage was sufficiently low, with a dry heat shrinkage of 11%. Again, the temperature at which the shrinkage stress maximum was shown was sufficiently high at 128° C. The radius of curvature of the interface of the two components was 80 μm

Example 2

Using a polymer combination of titanium dioxide-free homo PTT of melt viscosity 700 poise and homo PET of melt viscosity 390 poise containing 0.03 wt% titanium dioxide, spinning was carried out in the same way as in Example 1, and 168 dtex, 12-filament undrawn yarn was wound up. The melt viscosity ratio at this time was 1.75 and a side by side bicomponent fibre was formed of shape as in FIG. 3(*b*). Subsequently, using the drawing machine with a hot plate illustrated in FIG. 7, drawing was carried out with the temperature of the 1HR 13 at 70° C. and the temperature of hot plate 17 at 165° C., at a draw ratio of 3.00. In both the spinning and drawing, yarn production was good and there were no yarn breaks. The properties of the yarn are given in Table 2, and outstanding crimpability was shown with the PTT at the inside of the crimp. Furthermore, the crimp diameter manifested by the heat treatment for measuring $E_0$ was extremely small, at 190 μm, so an extremely high quality product was formed. Moreover, the yarn was sufficiently soft, with an initial modulus of 44 cN/dtex, and the shrinkage was sufficiently low, with the dry heat shrinkage being 11%. Again, the temperature at which the shrinkage stress maximum was shown was sufficiently high at 145° C. The radius of curvature of the interface of the two components was 40 μm

Example 3

Using a polymer combination of titanium dioxide-free homo PTT of melt viscosity 1900 poise and homo PET of melt viscosity 390 poise containing 0.03 wt% titanium dioxide, spinning was carried out in the same way as in Example 1 at a take-up velocity of 1350 m/min using the 12-hole insert type conjugate fibre spinneret (FIG. 2(*b*)) described in JP-A-9-157941, and 190 dtex, 12-filament undrawn yarn wound up. The melt viscosity ratio at this time was 4.87 and there was formed a side by side bicomponent fibre of shape as in FIG. 3(*b*). Subsequently, drawing was carried out in the same way as in Example 2, at a draw ratio of 3.40. In both the spinning and drawing, yarn production was good. The properties of the yarn are given in Table 2, and outstanding crimpability was shown with the PTT at the inside of the crimp. Furthermore, the crimp diameter manifested by the heat treatment for measuring $E_0$ was extremely small, at 190 μm, so an extremely high quality product was formed. Moreover, the yarn was sufficiently soft, with an initial modulus of 44 cN/dtex, and the shrinkage was sufficiently low, with the dry heat shrinkage being 11%. Again, the temperature at which the shrinkage stress maximum was shown was sufficiently high at 145° C. Now, while still within the permitted range, there was an increase in yarn breakage in the spinning and drawing compared to Examples 1 and 2. The radius of curvature of the interface of the two components was 25 μm Example 4

A polymer combination of titanium dioxide-free homo PTT of melt viscosity 1500 poise and titanium dioxide-free homo PTT of melt viscosity 400 poise was separately melted at 270° C. and 260° C. respectively, after which spinning was carried out in the same way as in Example 1 at a spinning temperature of 265° C. and a take-up velocity of 1350 m/min using a 12-hole insert type conjugate fibre spinneret (FIG. 2(*b*)) as described in JP-A-9-157941, and 132 dtex, 12-filament undrawn yarn wound up. The melt viscosity ratio at this time was 3.75 and there was formed a side by side bicomponent fibre of shape as in FIG. 3(*b*). Subsequently, drawing was carried out in the same way as in Example 2 with the temperature of the 1HR 13 at 65° C. and the temperature of the 2HR 14 at 130° C., at a draw ratio of 2.35. In both the spinning and drawing, yarn production was good. The properties of the yarn are given in Table 2, and outstanding crimpability was shown with the high viscosity PTT at the inside of the crimp. Furthermore, the crimp diameter manifested by the heat treatment for measuring $E_0$ was extremely small, at 190 μm, so an extremely high quality product was formed. Moreover, it was sufficiently soft, with an initial modulus of 22 cN/dtex, and the shrinkage was sufficiently low, with the dry heat shrinkage being 12%. Again, the temperature at which the shrinkage stress maximum was shown was sufficiently high at 125° C. Now, while still within the permitted range, there was an increase in yarn breakage in the spinning and drawing compared to Examples 1 and 2. The radius of curvature of the interface of the two components was 60 μm Example 5

A polymer combination of titanium dioxide-free homo PTT of melt viscosity 700 poise (intrinsic viscosity 1.18) and homo PBT of melt viscosity 600 poise (intrinsic viscosity 0.82) containing 0.03 wt% titanium dioxide was spun in the same way as in Example 4, and 168 dtex, 12-filament undrawn yarn wound up. The melt viscosity ratio at this time was 1.17 and there was formed a side by side bicomponent fibre of shape as in FIG. 3(*b*). Subsequently, drawing was carried out using the drawing machine with a hot plate shown in FIG. 7, with the temperature of the 1HR 13 at 65° C. and the temperature of the hot plate 17 at 160° C., at a draw ratio of 3.00. The properties of the yarn are given in Table 2, and outstanding crimpability was shown with the PTT at the inside of the crimp. Furthermore, the crimp diameter manifested by the heat treatment for measuring $E_0$ was small, at 220 μm, so a high quality product was formed. Moreover, the yarn was sufficiently soft, with an initial modulus of 34 cN/dtex, and the shrinkage was sufficiently low, with the dry heat shrinkage being 12%. Again, the temperature at which the shrinkage stress maximum was shown was sufficiently high at 153° C. The radius of curvature of the interface of the two components was 28 μm Example 6

Using a polymer combination of titanium dioxide-free homo PBT of melt viscosity 1150 poise and homo PTT of melt viscosity 300 poise containing 0.03 wt% titanium dioxide, spinning was carried out in the same way as in Example 4. The melt viscosity ratio at this time was 3.83 and there was formed a side by side bicomponent fibre of shape as in FIG. 3(*b*), of radius of curvature 46 μm. Subsequently, drawing was carried out using the drawing machine with a hot plate shown in FIG. 7, with the temperature of the 1HR 13 at 65° C. and the temperature of the hot plate 17 at 160° C., at a draw ratio of 3.00. The properties of the yarn are given in Table 2, and outstanding crimpability was shown with the PBT at the inside of the crimp. The crimp diameter manifested by the heat treatment for measuring $E_0$ was 290 μm, so the quality was somewhat inferior to that of Example 1. Moreover, the yarn was sufficiently soft, with an initial modulus of 31 cN/dtex, and the shrinkage was sufficiently low, with the dry heat shrinkage being 11%. Again, the temperature at which the shrinkage stress maximum was shown was sufficiently high at 150° C. Now, while within the permitted range, there were increased yarn breaks in the spinning and drawing compared to Examples 1 and 2.

Example 7

Melt spinning was carried out under the same conditions as in Example 2 except that the take-up velocity was made 3000 m/min and 77 dtex 12-filament undrawn yarn was produced. Using this undrawn yarn, drawing was carried out under the same conditions as in Example 2 except that the draw ratio was made 1.40. Yarn production was good in both the spinning and drawing and there were no yarn breaks. The properties of the yarn are given in Table 2, and outstanding crimpability was shown with the PTT at the inside of the crimp. Furthermore, the crimp diameter manifested by the heat treatment for measuring $E_0$ was low, at 220 μm, so an extremely high quality product was formed.

Example 8

Melt spinning was carried out under the same conditions as in Example 1 except that instead of the side by side bicomponent yarn there was produced a eccentrically disposed sheath core conjugate fibres (FIG. 3(*h*)) and the polymers and conjugate ratio were changed as follows. There was employed at this time, as the sheath polymer, 60 wt% PET of melt viscosity 400 poise containing 0.40 wt% titanium dioxide and, as the core polymer, 40 wt% titanium dioxide-free PTT of melt viscosity 700 poise. The undrawn yarn was drawn under the same conditions as in Example 1 except that the draw ratio was made 2.60 and the temperature of the 2HR 14 was made 140° C. Yarn production was good in both the spinning and drawing and there were no yarn breaks. The properties are given in Table 2 and outstanding crimpability was shown. Furthermore, the crimp diameter manifested by the heat treatment for measuring $E_0$ was low, at 240 μm, and a high quality product was formed.

Example 9

Melt spinning was carried out under identical conditions to those in Example 2, except that the fibre cross-sectional shape was a hollow section (FIG. 3(*f*)), and 168 dtex, 12 filament undrawn yarn was wound up. Using this undrawn yarn, drawing was carried out under the same conditions as in Example 2 except that the draw ratio was made 2.95. The properties are given in Table 1, and outstanding crimpability was shown with the PTT at the inside of the crimp. Furthermore, the crimp diameter manifested by the heat treatment for measuring $E_0$ was low, at 240 μm, and a high quality product was formed.

Example 10

Spinning was carried out in the same way as in Example 1 except that the PTT in Example 1 was changed to titanium dioxide-free polybutylene terephthalate (below referred to as PBT) of melt viscosity 390 poise, and 168 dtex, 12 filament undrawn yarn was wound up. Drawing was carried out in the same way as in Example 1, at a draw ratio of 3.00, and soft stretch yarn obtained. The properties are given in Table 2 and good crimpability was shown. Now, the stress in terms of 50% stretch exceeded $10\times10^{-3}$ cN/dtex and the recovery was less than 70%, so the softness and stretchability were somewhat inferior to those in Example 1. Furthermore, the crimp diameter manifested by the heat treatment for measuring $E_0$ was 300 $\mu$m, and so the product quality too was somewhat inferior to Example 1. Moreover, the crimp phase was random compared to Example 1.

Example 11

Spinning was carried out in the same way as in Example 2, except that the PTT in Example 2 was changed to titanium dioxide-free PBT of melt viscosity 1050 poise, and 190 dtex, 12 filament undrawn yarn was wound up. Drawing was carried out in the same way as in Example 1, at a draw ratio of 3.40, and soft stretch yarn obtained. The properties are given in Table 2 and good crimpability was shown. Now, the recovery in terms of 50% stretch was less than 70%, so the stretchability was somewhat inferior to that in Example 2. Furthermore, the crimp diameter manifested by the heat treatment for measuring $E_0$ was 280 $\mu$m, and the product quality too was somewhat inferior to Example 1. Moreover, the crimp phase was random compared to Example 2. Furthermore, with the initial modulus at 55 cN/dtex, the softness was somewhat inferior to Example 2 but the dry heat shrinkage was sufficiently low at 12%. The temperature at which the maximum shrinkage stress was shown was sufficiently high, at 128° C. While still within the permitted range, there was an increase in yarn breaks during spinning and drawing when compared to Examples 1 and 2.

Example 12

Spinning was carried out in the same way as in Example 1 except that the PTT in Example 1 was changed to titanium dioxide-free PBT of melt viscosity 390 poise, and the take-up velocity was made 6000 m/min. 62 dtex, 12 filament undrawn yarn was obtained. Drawing was carried out in the same way as in Example 1 except that the draw ratio was 1.10, and in this way soft stretch yarn was obtained. The properties are given in Table 2, and good crimpability was shown. However, the recovery in terms of 50% stretch was less than 70%, so the stretchability was somewhat inferior to that in Example 6. Furthermore, the crimp diameter manifested by the heat treatment for measuring $E_0$ was 260 $\mu$m, and the product quality too was somewhat inferior to Example 1. Again, the crimp phase was random compared to Example 1.

Example 13

Using the direct spin draw machine shown in FIG. 8, drawing was carried out in the same way as in Example 2 with the peripheral velocity of 1HNR 18=1500 m/min and temperature=75° C., peripheral velocity of 2HNR 19=4500 m/min and temperature=130° C. 56 dtex, 12 filament soft stretch yarn was wound up. The properties are given in Table 2 and good crimpability was shown with the PTT on the inside of the crimp. Furthermore, the crimp diameter manifested by the heat treatment for measuring $E_0$ was extremely low, at 200 $\mu$m, and an extremely high quality product was formed. Moreover, the initial modulus was 42 cN/dtex, so the yarn was sufficiently soft, and the dry heat shrinkage was also sufficiently low at 10%. Again, the temperature at which the maximum shrinkage stress was shown was sufficiently high at 128° C.

Example 14

Figure 9:
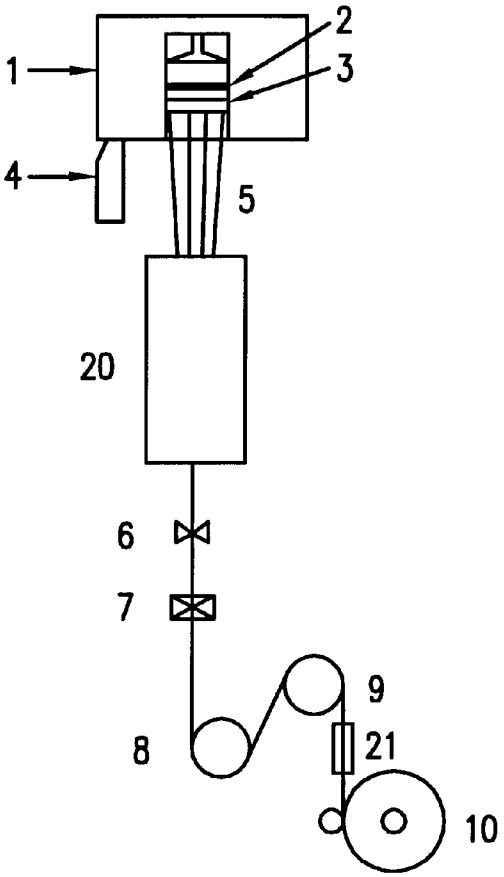
FIGS. 8 and 9 are diagrams showing direct spin draw machines.

Using the direct spin draw machine shown in FIG. 9, drawing was carried out in the same way as in Example 2 with the temperature of the non-contact heater 20=190° C., the take-up velocity=5000 m/min, and a 100° C. steam heat treatment carried out between the 2GD 9 and winder 10. The properties of the soft stretch yarn obtained are given in Table 2 and good crimpability was shown with the PTT on the inside of the crimp. Furthermore, the crimp diameter manifested by the heat treatment for measuring $E_0$ was extremely low, at 190 $\mu$m, and an extremely high quality product was formed. The crimp phase varied between individual filaments and there was a sense of high bulkiness compared to Example 2. Furthermore, the initial modulus was 43 cN/dtex so the yarn was sufficiently soft, and the dry heat shrinkage was also sufficiently low at 12%. Again, the temperature at which the maximum shrinkage stress was shown was sufficiently high at 126° C.

Example 15

Melt spinning was carried out under the same conditions as in Example 2 except that the take-up velocity was changed to 7000 m/min. This yarn could be used in the wound state without drawing. The properties are given in Table 2 and excellent crimpability was shown. Again, the crimp diameter manifested by the heat treatment for measuring $E_0$ was extremely low, at 120 $\mu$m, and the crimp phase varied between individual filaments, so that there was a sense of bulkiness as compared with Example 2. Moreover, with a dry heat shrinkage of 5%, the yarn had sufficiently low shrinkage.

Comparative Example 1

Spinning was carried out in the same way as in Example 2 using a polymer combination of titanium dioxide-free homo PTT of melt viscosity 850 poise and homo PET of melt viscosity 850 poise containing 0.03 wt% titanium dioxide, at a take-up velocity of 900 m/min and a spinning temperature of 286° C. 168 dtex, 12 filament undrawn yarn was obtained. Drawing and heat setting were carried out in the same way as in Example 2. The properties are given in Table 2 and, while a certain degree of crimpability was shown, since the spinning temperature was high and there was thermal degradation on the PTT side the spinning was unstable. Moreover, since the undrawn yarn take-up velocity was low, there was considerable yarn oscillation during the spinning process and considerable variation in the solidification point. Hence, the strength of the drawn yarn was markedly lowered and there was a deterioration in the Uster unevenness. Again, the stress in terms of 50% stretch exceeded $50\times10^{-3}$ cN/dtex, so the softness and stretchability did not reach the levels in Example 2.

Comparative Example 2

The polymer combination in Comparative Example 1 was spun in the same way as in Example 1 at a spinning temperature of 280° C. and a take-up velocity of 1500 m/min, and 146 dtex 12 filament undrawn yarn obtained. Drawing and heat setting were carried out in the same way as in Example 2 except that the draw ratio was 2.70 and the temperature of the 1HR 13 was 100° C. The properties are given in Table 2 and, while a certain degree of crimpability was shown, since the temperature of the 1HR 13 was high there was thermal degradation of the PTT and frequent yarn breakage occurred. Moreover, the strength of the drawn yarn obtained was low and there was a deterioration in the Uster unevenness. Again, the stress in terms of 50% stretch exceeded $50\times10^{-3}$ cN/dtex, so the softness and stretchability did not reach the levels in Example 2.

Comparative Example 3

Homo PET polymers containing 0.03 wt% of titanium dioxide and respectively having a melt viscosity of 130 poise (intrinsic viscosity 0.46) or 2650 poise (intrinsic viscosity 0.77) were separately melted at 275° C. and 290° C, and separately filtered using a stainless steel nonwoven filter of maximum pore diameter 20 $\mu$m, after which they were spun at a spinning temperature of 290° C. from a 12-hole insert type spinneret (FIG. 2(*b*)) as described in JP-A-9-157941 to form side by side bi-component fibre (FIG. 3(*a*)) of conjugate ratio 1:1. The melt viscosity ratio at this time was 20.3. At a take-up velocity of 1500 m/min, 154 dtex 12-filament undrawn yarn was wound up. Subsequently, drawing was carried out with the temperature of the 1HR 13 at 90° C. and the temperature of hot plate 17 at 150° C., at a draw ratio of 2.80. In both the spinning and drawing, yarn production was poor and there were frequent yarn breaks. The properties of the yarn are given in Table 2, but the stress in terms of 50% stretch exceeded $50\times10^{-3}$ cN/dtex and it was not possible to produce the soft stretch yarn of the present invention. Again, $E_{3.5}$ =0.5% and the crimpability in a constrained state was low. Furthermore, with the initial modulus being 75 cN/dtex, the yarn lacked softness.

Comparative Example 4

Homo PET of melt viscosity 2000 poise containing 0.03 wt% titanium dioxide and copolymer PET of melt viscosity 2100 poise in which 10 mol% of isophthalic acid had been copolymerized as an acid component and which contained 0.03 wt% titanium dioxide were separately melted at 285° C. and 275° C. respectively, and then spinning carried out in the same way as in Example 1 at a spinning temperature of 285° C. and a take-up velocity of 1500 m/min. 154 dtex, 12 filament undrawn yarn was wound up. Subsequently, drawing was carried out in the same way as in Comparative Example 3 at a draw ratio of 2.75. In both the spinning and drawing, yarn production was good and there were no yarn breaks. The properties of the yarn are given in Table 2, but the stress in terms of 50% stretch exceeded $50\times10^{-3}$ cN/dtex and it was not possible to produce the soft stretch yarn of the present invention. Again, with $E_{3.5}$=0.4%, the crimpability in a constrained state was low.

TABLE 1

| | Process | Polymer Combination | Melt Viscosity Ratio | Spinning Temperature (° C.) | Take-up Velocity (m/min) | Drawing Temperature (° C.) | Heat Setting Temperature (° C.) |
|---|---|---|---|---|---|---|---|
| Ex. 1 | 2-stage | PTT/PET | 1.08 | 275 | 1500 | 70 | 130 |
| Ex. 2 | 2-stage | PTT/PET | 1.75 | 275 | 1500 | 70 | 165 |
| Ex. 3 | 2-stage | PTT/PET | 4.87 | 275 | 1350 | 70 | 165 |
| Ex. 4 | 2-stage | PTT/PTT | 3.75 | 265 | 1350 | 65 | 130 |
| Ex. 5 | 2-stage | PTT/PBT | 1.17 | 265 | 1350 | 65 | 160 |
| Ex. 6 | 2-stage | PBT/PTT | 3.83 | 265 | 1350 | 65 | 160 |
| Ex. 7 | 2-stage | PTT/PET | 1.75 | 275 | 3000 | 70 | 165 |
| Ex. 8 | 2-stage | PTT/PET | 1.75 | 275 | 1500 | 70 | 140 |
| Ex. 9 | 2-stage | PTT/PET | 1.75 | 275 | 1500 | 70 | 165 |
| Ex. 10 | 2-stage | PBT/PET | 1.03 | 275 | 1500 | 70 | 130 |
| Ex. 11 | 2-stage | PBT/PET | 2.84 | 275 | 1500 | 70 | 130 |
| Ex. 12 | 2-stage | PBT/PET | 1.03 | 275 | 6000 | 70 | 130 |
| Ex. 13 | 1-stage | PTT/PET | 1.75 | 275 | 1500 | 75 | 130 |
| Ex. 14 | 1-stage | PTT/PET | 1.75 | 275 | — | — | — |
| Ex. 15 | 1-stage | PTT/PET | 1.75 | 275 | 7000 | — | — |
| Comp. 1 | 2-stage | PTT/PET | 1.00 | 286 | 900 | 70 | 165 |
| Comp. 2 | 2-stage | PTT/PET | 1.00 | 280 | 1500 | 100 | 165 |
| Comp. 3 | 2-stage | PET/PET | 20.3 | 290 | 1500 | 90 | 150 |
| Comp. 4 | 2-stage | PET/PET | 1.05 | 285 | 1500 | 90 | 150 |

TABLE 2

| | Stress (cN/dtex) | Recovery (%) | $E_0$ (%) | $E_{3.5}$ (%) | Crimp Retention (%) | TS | Elongation U% | Elongation (%) | Strength |
|---|---|---|---|---|---|---|---|---|---|
| Ex. 1 | $6.0\times10^{-3}$ | 71 | 45.0 | 12.2 | 92 | 0.31 | 0.9 | 28.0 | 3.6 |
| Ex. 2 | $5.5\times10^{-3}$ | 77 | 67.0 | 15.0 | 95 | 0.32 | 0.9 | 26.0 | 3.7 |
| Ex. 3 | $4.5\times10^{-3}$ | 81 | 75.0 | 15.8 | 96 | 0.34 | 0.9 | 27.8 | 3.9 |
| Ex. 4 | $4.0\times10^{-3}$ | 80 | 70.3 | 15.2 | 96 | 0.32 | 1.0 | 27.0 | 3.7 |

TABLE 2-continued

| | Stress (cN/dtex) | Recovery (%) | $E_0$ (%) | $E_{3.5}$ (%) | Crimp Retention (%) | TS | U% | Elongation (%) | Strength |
|---|---|---|---|---|---|---|---|---|---|
| Ex. 5 | $6.0 \times 10^{-3}$ | 68 | 51.0 | 14.8 | 98 | 0.30 | 0.9 | 26.8 | 3.1 |
| Ex. 6 | $3.6 \times 10^{-3}$ | 74 | 63.5 | 23.8 | 98 | 0.26 | 1.0 | 25.8 | 3.0 |
| Ex. 7 | $7.5 \times 10^{-3}$ | 70 | 42.4 | 11.5 | 92 | 0.26 | 0.9 | 27.8 | 3.2 |
| Ex. 8 | $8.5 \times 10^{-3}$ | 70 | 40.1 | 11.1 | 90 | 0.31 | 1.1 | 29.1 | 3.5 |
| Ex. 9 | $9.5 \times 10^{-3}$ | 70 | 41.2 | 11.2 | 90 | 0.29 | 1.3 | 27.3 | 3.2 |
| Ex. 10 | $10.5 \times 10^{-3}$ | 61 | 38.5 | 15.4 | 98 | 0.30 | 1.0 | 27.8 | 3.0 |
| Ex. 11 | $5.8 \times 10^{-3}$ | 68 | 56.0 | 20.2 | 98 | 0.33 | 1.0 | 27.2 | 3.9 |
| Ex. 12 | $5.2 \times 10^{-3}$ | 67 | 58.3 | 21.4 | 98 | 0.35 | 1.0 | 34.0 | 3.7 |
| Ex. 13 | $6.0 \times 10^{-3}$ | 77 | 65.0 | 15.0 | 95 | 0.32 | 0.9 | 25.0 | 3.6 |
| Ex. 14 | $5.5 \times 10^{-3}$ | 79 | 68.0 | 15.0 | 95 | 0.32 | 0.9 | 22.3 | 3.5 |
| Ex. 15 | $5.1 \times 10^{-3}$ | 75 | 65.0 | 10.0 | 95 | 0.24 | 0.8 | 34.5 | 3.1 |
| Comp. 1 | $>50 \times 10^{-3}$ | 62 | 44.2 | 9.4 | 86 | 0.34 | 3.2 | 28.2 | 2.1 |
| Comp. 2 | $>50 \times 10^{-3}$ | 67 | 42.0 | 9.2 | 86 | 0.32 | 3.5 | 25.0 | 2.1 |
| Comp. 3 | $>50 \times 10^{-3}$ | 65 | 48.3 | 0.5 | 65 | 0.21 | 1.5 | 20.1 | 3.1 |
| Comp. 4 | $>50 \times 10^{-3}$ | 45 | 41.2 | 0.4 | 60 | 0.30 | 1.0 | 28.8 | 4.5 |

TS = maximum value of shrinkage stress (cN/dtex)
strength = strength of soft stretch yarn (CN/dtex)

Example 16

Using the yarns obtained in Examples 1 to 15 and Comparative Examples 1 to 4, twisting was carried out at 700 turns/m and twist setting conducted by steam at 65° C. Then, using a 28 gauge circular knitter, knitted materials with an interlock structure were produced. These were subjected to relaxation scouring at 90° C. in accordance with normal procedure, after which presetting was carried out at 180° C. Furthermore, after a 10 wt% caustic treatment again in accordance with normal procedure, dyeing was conducted at 130° C.

The handle of the materials obtained were subjected to functional evaluation (Table 3). Where the soft stretch yarns of Examples 1 to 13 had been used, the softness and stretchability were excellent and, furthermore, the material surface was highly attractive. Moreover, in the case of Examples 1 to 4 and 7, 12 and 13, the crimp coil diameter was sufficiently low so knitted materials of outstanding attractiveness were produced. On the other hand, in the case of Comparative Examples 1 and 2, dyeing unevenness occurred and the fabrics were of poor quality. Moreover, in Comparative Examples 3 and 4, the handle was coarse.

TABLE 3

| Yarn Used | Soft-ness | Bulki-ness | Re-silience | Stretch-ability | Dyeing Evenness | Surface Impression |
|---|---|---|---|---|---|---|
| Ex. 1 | 4 | 3 | 3 | 4 | 5 | 4 |
| Ex. 2 | 4 | 3 | 3 | 5 | 5 | 5 |
| Ex. 3 | 4 | 3 | 3 | 5 | 5 | 5 |
| Ex. 4 | 4 | 3 | 3 | 5 | 4 | 5 |
| Ex. 5 | 4 | 3 | 3 | 4 | 5 | 4 |
| Ex. 6 | 5 | 3 | 3 | 5 | 4 | 4 |
| Ex. 7 | 4 | 3 | 3 | 4 | 5 | 4 |
| Ex. 8 | 4 | 3 | 3 | 4 | 4 | 4 |
| Ex. 9 | 4 | 3 | 3 | 4 | 3 | 4 |
| Ex. 10 | 3 | 3 | 3 | 3 | 4 | 3 |
| Ex. 11 | 4 | 3 | 3 | 3 | 4 | 3 |
| Ex. 12 | 4 | 3 | 3 | 3 | 4 | 3 |
| Ex. 13 | 4 | 4 | 3 | 5 | 5 | 5 |
| Ex. 14 | 4 | 4 | 3 | 5 | 5 | 5 |
| Ex. 15 | 4 | 4 | 3 | 4 | 5 | 5 |
| Comp. 1 | 2 | 3 | 3 | 2 | 1 | 2 |
| Comp. 2 | 2 | 3 | 3 | 2 | 1 | 2 |
| Comp. 3 | 1 | 2 | 3 | 2 | 3 | 2 |
| Comp. 4 | 1 | 2 | 2 | 2 | 4 | 2 |

Example 17

Using the yarns obtained in Examples 1 to 15 and in Comparative Examples 3 and 4, twisting was carried out at 1500 turns/m and twist setting conducted by steam at 65° C. Then, in each case, a plain weave fabric was constructed using the same yarn for the warp and weft. The yarn densities at this time were warp=110 per inch and weft=91 per inch, and a torque balance was obtained by alternate placement of S-twist/Z-twist yarns. The cloth obtained was processed as follows. Firstly, relaxation scouring was conducted at 90° C., after which presetting was carried out with dry heat at 180° C. using a pin stenter. Furthermore, after a 15% caustic treatment in the usual way, dyeing was carried out at 130° C., once again by normal procedure.

The handle of the fabrics obtained was subjected to functional evaluation (Table 4). As predicted from the properties of the yarn, with the fabrics produced from the yarns in Examples 1 to 13 stretchability was manifested in each case, whereas the stretchability was poor in the case of Comparative Examples 3 and 4.

TABLE 4

| Yarn Used | Soft-ness | Bulki-ness | Re-silience | Stretch-ability | Dyeing Evenness | Surface Impression |
|---|---|---|---|---|---|---|
| Ex. 1 | 4 | 3 | 3 | 4 | 5 | 4 |
| Ex. 2 | 4 | 4 | 3 | 5 | 5 | 5 |
| Ex. 3 | 4 | 3 | 3 | 5 | 5 | 5 |
| Ex. 4 | 4 | 3 | 3 | 5 | 4 | 5 |
| Ex. 5 | 4 | 3 | 3 | 4 | 5 | 4 |
| Ex. 6 | 5 | 3 | 3 | 5 | 4 | 4 |
| Ex. 7 | 4 | 3 | 3 | 4 | 5 | 4 |
| Ex. 8 | 4 | 3 | 3 | 4 | 4 | 4 |
| Ex. 9 | 4 | 3 | 3 | 4 | 3 | 4 |
| Ex. 10 | 3 | 3 | 3 | 3 | 4 | 3 |
| Ex. 11 | 4 | 3 | 3 | 3 | 4 | 3 |
| Ex. 12 | 4 | 3 | 3 | 3 | 4 | 3 |
| Ex. 13 | 4 | 5 | 3 | 5 | 5 | 5 |
| Ex. 14 | 4 | 5 | 3 | 5 | 5 | 5 |
| Ex. 15 | 4 | 4 | 3 | 4 | 5 | 5 |
| Comp. 1 | 2 | 3 | 3 | 2 | 1 | 2 |
| Comp. 2 | 2 | 3 | 3 | 2 | 1 | 2 |
| Comp. 3 | 1 | 2 | 3 | 1 | 3 | 2 |
| Comp. 4 | 1 | 2 | 2 | 1 | 4 | 2 |

Example 18

Using the soft stretch yarns obtained in Examples 13 and 14 as warp and weft without applying twist, plain weave fabrics were produced. The yarn densities at this time were warp=110 per inch and weft=91 per inch. The cloths obtained was processed as follows. Firstly, relaxation scouring was conducted at 90° C., after which presetting was carried out with dry heat at 180° C. using a pin stenter. Dyeing was carried out at 130° C. by normal procedure.

The materials obtained had a plain surface and were very smooth. They were suitable as soft stretch linings.

Example 19

Using the soft stretch yarns obtained in Examples 1, 2, 8 and 9, and in Comparative Examples 3 and 4, combined filament yarns were produced along with low-shrink PET yarn under the conditions given in Table 5, and twist setting carried by steam at 65° C. Weaving, processing and evaluation were conducted in the same way as in Example 17.

The handle of the fabrics obtained was subjected to functional evaluation (Table 6). As predicted from the properties of the yarn, in the case of the fabrics produced from the yarns in the Examples a soft handle and excellent softness was shown, but where the yarns of Comparative Examples 3 and 4 were used there was a highly coarse feel.

TABLE 5

| Code | Yarn Used | Properties of the Other Yarn used in the Combined Filament Yarn: Product Type | Boiling Shrinkage (%) | YM (cN/dex) | Twist in Combined Filament Yarn (T/m) | Yarn Density (warp × weft) (yarns per inch) |
|---|---|---|---|---|---|---|
| A | Example 1 | 55 dtex-24 fil | −1.0 | 35 | 400 | 101 × 90 |
| B | Example 2 | 55 dtex-24 fil | −2.0 | 30 | 400 | 101 × 90 |
| C | Example 2 | 55 dtex-24 fil | 1.0 | 35 | 400 | 101 × 90 |
| D | Example 2 | 55 dtex-24 fil | 8.0 | 76 | 400 | 101 × 90 |
| E | Example 2 | 75 dtex-144 fil | 6.5 | 35 | 600 | 99 × 84 |
| F | Example 2 | 55 dtex-12 fil | 1.0 | 35 | 400 | 101 × 90 |
| G | Example 8 | 75 dtex-144 fil | −1.0 | 34 | 800 | 99 × 84 |
| H | Example 9 | 55 dtex-24 fil | 1.0 | 32 | 400 | 101 × 90 |
| I | Comp. Ex. 3 | 55 dtex-24 fil | 1.0 | 35 | 400 | 101 × 90 |
| J | Comp. Ex. 4 | 55 dtex-24 fil | 1.0 | 35 | 400 | 101 × 90 |

YM: Young's modulus

TABLE 6

| Code | Softness | Bulkiness | Resilience | Stretchability | Dyeing Evenness | Surface Impression |
|---|---|---|---|---|---|---|
| A | 4 | 5 | 5 | 4 | 5 | 4 |
| B | 4 | 5 | 5 | 5 | 5 | 4 |
| C | 4 | 4 | 4 | 5 | 5 | 4 |
| D | 3 | 3 | 3 | 5 | 5 | 4 |
| E | 5 | 3 | 4 | 5 | 5 | 4 |
| F | 3 | 4 | 5 | 5 | 5 | 4 |
| G | 4 | 5 | 4 | 5 | 5 | 4 |
| H | 3 | 4 | 4 | 3 | 3 | 3 |
| I | 1 | 3 | 2 | 1 | 4 | 2 |
| J | 1 | 3 | 2 | 1 | 4 | 2 |

Example 20

A plain weave fabric was constructed using the untwisted soft stretch yarn obtained in Example 13 as the weft, and using the cuprammonium rayon "Cupra" produced by the Asahi Chemical Ind. Co. (83 dtex, 45 filament) as the warp. The yarn densities at this time were warp=110 per inch and weft=91 per inch. The fabric obtained was processed as follows. Firstly, relaxation scouring was carried out at 90° C., after which presetting was performed with dry heat at 150° C. using a pin stenter. Furthermore, dyeing was carried out at 100° C.

The woven material obtained was soft and had good stretchability. Furthermore, a highly dry feel was apparent due to the marked coolness of touch characteristic of the cuprammonium rayon. Again, the moisture absorption/release properties and the smoothness of the material surface were good, and it was suitable as a stretch lining.

Example 21

Using the soft stretch yarn obtained in Example 2, this was subjected to twisting at 700 turns/m and twist setting carried out by means of steam at 65° C. Furthermore, with this as the weft and using the viscose rayon "Silma" manufactured by the Asahi Chemical Ind. Co. (83 dtex, 38 filament) as the warp, a plain weave fabric was constructed. The yarn densities at this time were warp=110 per inch and weft=91 per inch and a torque balance was obtained by alternate arrangement of S twist/Z twist yarns. The fabric obtained was processed as follows. Firstly, relaxation scouring was carried out at 90° C., after which presetting was performed with dry heat at 150° C. using a pin stenter. Moreover, dyeing was carried out at 100° C. The woven material obtained was soft and had good stretchability. Furthermore, a springy sense of touch was obtained due to the excellent resilience characteristic of the viscose rayon and, moreover, a dry feel was apparent due to the high coolness of touch. In addition the moisture absorption/release was good.

Example 22

Using the soft stretch yarn obtained in Example 2, this was subjected to twisting at 550 turns/m and twist setting carried out by means of steam at 65° C. With this, there was mixed the cuprammonium rayon employed in Example 20, and a knitted material with an interlock structure constructed by means of 24 gauge circular knitting. Following normal procedure, this was subjected to relaxation scouring at 90° C., after which dyeing was carried out at 100° C.

The knitted material obtained was soft and had good stretchability. Furthermore, a very dry feel was apparent due to the high coolness of touch characteristic of the cuprammonium rayon. Moreover, the moisture absorption/release was good.

Example 23

A knitted material was constructed in the same way as in Example 22, except that instead of the cuprammonium rayon there was used the viscose rayon employed in Example 21.

The knitted material obtained was soft and had good stretchability. Furthermore, a springy sense of touch was obtained due to the excellent resilience which is characteristic of the viscose rayon and, moreover, a very dry feel was apparent due to the high coolness of touch. In addition, the moisture absorption/release was good.

Effects of the Invention

By means of a yarn embodying the present invention, the conventional problems of a strong feeling of tightness and a coarsening of the fabric can be resolved, and it is possible to offer soft stretch yarns which can provide materials with more outstanding soft stretchability than hitherto, and the fabrics produced from said yarns.

What is claimed is:

1. A yarn comprising polyester fibres which yarn is characterized in that following heat treatment the yarn has a stress, at 50% yarn stretch, of no more than $30\times10^{-3}$ cN/dtex and, at the same time, a percentage recovery of at least 60%.

2. A yarn according to claim 1 where the Uster unevenness is no more than 2.0%.

3. A yarn according to claim 1 where the diameter of the crimp is no more than 250 $\mu$m.

4. A yarn according to claim 3 where the diameter of the crimp is no more than 200 $\mu$m.

5. A yarn according to claim 1, having a strength of at least 2.2 cN/dtex and a shrinkage stress of at least 0.25 cN/dtex.

6. A yarn according to claim 1, having a crimp retention factor after stretching 10 times of at least 85%.

7. A yarn according to claim 6, where the crimp retention factor after stretching 10 times is at least 90%.

8. A yarn according to claim 7, where the crimp retention factor after stretching 10 times is at least 95%.

9. A yarn according to claim 1, which has conjugate fibres having at least two polyester components.

10. A yarn according to claim 9, wherein the conjugated fibre components are disposed eccentrically relative to one another in the cross-section of the fibres.

11. A yarn according to claim 9, wherein the ratio of the respective melt viscosities of the polyesters is from 1:1 to 5:1.

12. A yarn according to claim 9, where at least one component of the conjugate fibres is PTT or PBT.

13. A yarn according to claim 12, where at least one component of the conjugate fibres is PTT.

14. A yarn according to claim 13 where the conjugate fibres comprise PTT and PET.

15. A yarn according to claim 1, having a crimp stretch factor ($E_0$) when heat treated under no load of at least 45%.

16. A yarn according to claim 1, having a crimp stretch factor ($E_{3.5}$) when heat treated under a $3.5\times10^{-3}$ cN/dtex (4 mgf/d) load of at least 10%.

17. A combined yarn which is characterized in that the yarn has, in combination, a yarn component which is a yarn according to claim 1 and a yarn component which is a low shrinkage yarn of boiling water shrinkage no more than 10%.

18. A yarn according to claim 1 or a combined yarn according to claim 17, where a high twist coefficient of at least 5000 is applied:

twist coefficient=number of twists per 1 m (turns/m)× square root of denier (dtex×0.9).

19. A fabric which is characterized in that it is produced using at least a yarn according to claim 1.

20. A fabric which contains a yarn according to claim 1 at least as a component of a combined yarn.

21. A fabric which contains, as an entire yarn, a yarn according to claim 1.

22. A fabric according to claim 19 further comprising natural and/or semi-synthetic fibres.

23. A fabric according to claim 20, wherein the natural and/or semi-synthetic fibres are present as another component yarn in the combined yarn.

24. A fabric, which contains respective separate yarns according to of claim 1 and yarns of natural and/or semi-synthetic fibres.

* * * * *